United States Patent [19]

Ives

[11] 4,212,216

[45] Jul. 15, 1980

[54] DEFLECTOR FOR ATTACHMENT TO FIBER CHOPPER NOZZLE

[76] Inventor: Frank E. Ives, 26601 Dover Ct., Kent, Wash. 98031

[21] Appl. No.: 5,305

[22] Filed: Jan. 22, 1979

[51] Int. Cl.[2] ..... B65B 39/00; B26D 7/06

[52] U.S. Cl. ..... 83/165; 156/62.4; 19/0.3; 19/296; 83/701

[58] Field of Search ..... 83/162, 78, 701, 165; 156/62.2, 62.4; 19/0.3, 296

[56] References Cited

U.S. PATENT DOCUMENTS

| | | | |
|---|---|---|---|
| 3,521,688 | 7/1970 | Urschel et al. | 83/165 |
| 3,914,498 | 10/1975 | Videen | 156/62.4 |
| 4,071,389 | 1/1978 | Ives | 156/175 |
| 4,118,531 | 10/1978 | Hauser | 156/62.4 |

*Primary Examiner*—Donald R. Schran
*Attorney, Agent, or Firm*—Christensen, O'Connor, Johnson & Kindness

[57] ABSTRACT

A trough-like deflector is attached to the body of a fiber chopper and extends outwardly from the lower portion of the chopper nozzle opening. The sides of the deflector are upwardly divergent to form a trough extending generally in the direction of the flow path of fibers normally ejected from the nozzle. The deflector skews the flow path of fibers ejected from the sides of the nozzle in an upward and inward direction. The deflector prevents the loss of chopped fibers to spurious air currents created by the ejected fiber stream and promotes a more uniform lay-down of fibers onto a substrate.

5 Claims, 4 Drawing Figures

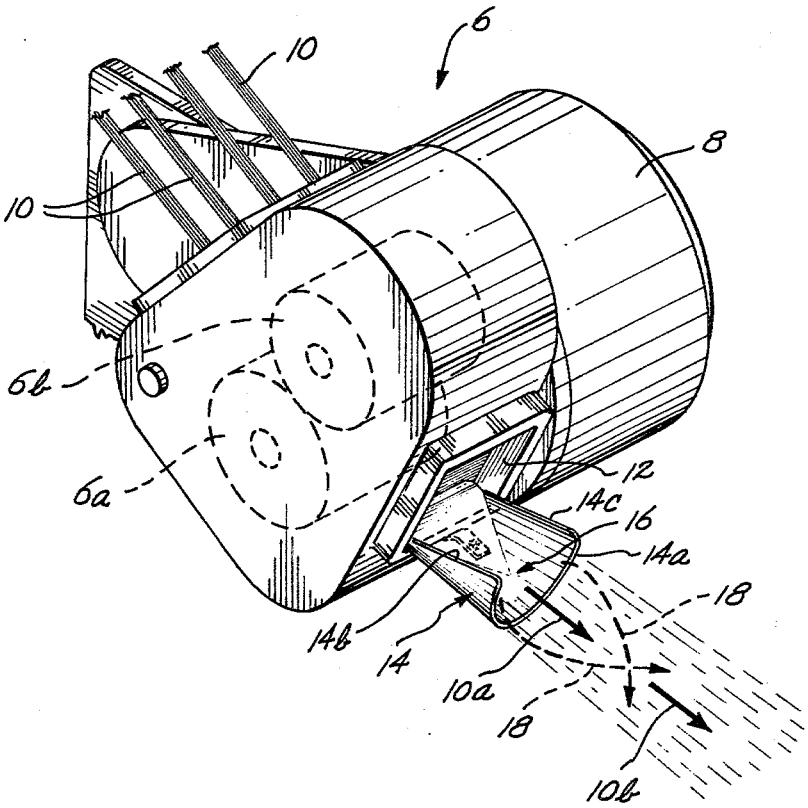
Fig. 1.
Fig. 2.
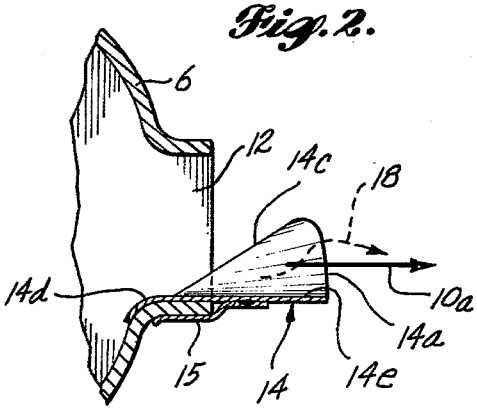
Fig. 3.
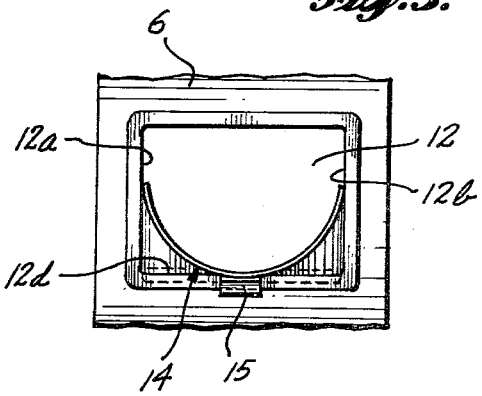
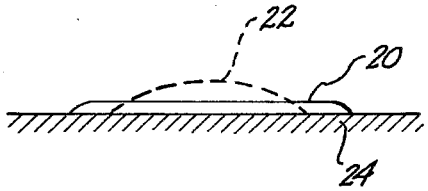
Fig. 4.

DEFLECTOR FOR ATTACHMENT TO FIBER CHOPPER NOZZLE

FIELD OF THE INVENTION

The present invention relates to glass fiber reinforced resin application equipment, more particularly to an improvement in an apparatus for chopping fibers used in connection with such equipment, and most particularly to a deflector attachment for a fiber chopper nozzle.

BACKGROUND OF THE INVENTION

Fiber choppers are employed in conjunction with liquid resin spray dispensers to form a stream of resin-impregnated chopped fibers that are laid down on a substrate to form a glass fiber reinforced structure. Typically, a fiber chopper has a body or housing, a backing roller and a chopping roller. As an elongated glass fiber strand passes between the rollers, it is chopped into relatively short fiber segments and propelled by the action of the rollers out through a nozzle opening in the body of the chopper. The body and thus the nozzle are oriented so as to direct the stream of fibers into intersecting relationship with a stream of catalyzed resin, thus forming a stream of resin-impregnated chopped fibers. The stream of resin impregnated fibers is directed toward a substrate, and is allowed to impinge the substrate and form a layer of resin-impregnated fibers on the substrate. One such apparatus is disclosed in U.S. Pat. No. 4,071,389 to Frank E. Ives, the disclosure of which is hereby expressly incorporated herein by reference.

Although fiber choppers similar to those described in the foregoing paragraph have operated successfully to build a wide variety of glass fiber reinforced structures, two problems have been associated with their use. First, the fibers propelled from the fiber strand chopper toward the resin spray have tended to float on and around the resin spray rather than impinging the resin spray and becoming impregnated. Those chopped fibers that do not intersect the resin spray are subjected to the drag of the ambient air and are slowed down sufficiently so that they ordinarily do not reach the substrate being coated. Other chopped fiber strands are caught in the moving airstream accompanying the fiber spray and are caused to loop around the fiber spray and be misdirected either toward the floor on which the substrate rests or toward a location on the substrate that is not coated with liquid resin. As a consequence, chopped fibers are wasted during application of a resin-impregnated fiber layer on the substrate.

The second problem associated with the operation of the prior art fiber choppers and resin spray equipment is the formation of a nonuniform layer of resin-impregnated fibers on the substrate. Prior equipment produces a layer that has an arcuate upper surface that extends outwardly from the substrat. It is most desirable to produce resin-impregnated fiber layers that have a relatively uniform thickness throughout the width of the layer rather than the thicker, narrow band of material that is formed by prior art equipment.

Accordingly, it is a broad object of the present invention to provide an improved fiber chopper that when associated with resin spray apparatus will form a resin-impregnated fiber layer on a substrate, which layer has a relatively uniform thickness throughout its width. It is another broad object of the present invention to provide an improved fiber chopper that does not allow chopped fiber segments to escape impregnation by an associated resin spray and that enables utilization of substantially all of the chopper fiber segments ejected from the fiber chopper.

SUMMARY OF THE INVENTION

In accordance with the foregoing objects, and other objects that will become apparent to one of ordinary skill in the art after reading the following specification, the present invention provides an improvement associated with the nozzle of a fiber chopper. The fiber chopper includes a body having a nozzle opening, and means associated with the body for chopping a fiber strand into fiber segments and for causing the fiber segments to be propelled from the nozzle. The improvement comprises means defining a forwardly extending, upwardly opening trough associated with the nozzle opening for receiving fiber segments ejected from the nozzle and causing those fibr segments ejected from the corner portions of the nozzle to be skewed upwardly an inwardly relative to the primary flow path of the fiber segments. The means defining the trough thus prevents the fiber segments ejected from the nozzle from looping around the resin spray and instead causes substantially all the fiber segments propelled from the nozzle to intersect the resin spray and become impregnated with resin. The thus-impregnated fibers are carried by the resin spray to an impingement location on a substrate, where the impregnated fibers are laid down in a uniformly thick layer. Accordingly, the present invention fulfills the foregoing objects by correcting the problems associated with prior art chopped fiber and resin spray application apparatus.

BRIEF DESCRIPTION OF THE DRAWINGS

A better understanding of the present invention can be derived by reading the ensuing specification in conjunction with the accompanying drawings, wherein:

FIG. 1 is an isometric view of a fiber chopper and the fiber deflector of the present invention;

FIG. 2 is a longitudinal sectional view through the nozzle portion of the fiber chopper and the fiber deflector of the present invention;

FIG. 3 is a front view of the nozzle and the fiber deflector of the present invention; and FIG. 4 is a cross sectional view of the layer of resin impregnated fiber laid down by the fiber chopper and associated resin spray equipment in accordance with the present invention.

DETAILED DESCRIPTION OF THE INVENTION

Referring to FIG. 1, a fiber strand chopper 6 of the type typically used to chop elongated fibers 10 into fiber segments has a body or housing in which are rotatably mounted a chopping roller *6a* and a backing roller *6b*. The chopping roller *6a* is driven by a motor 8 mounted on and externally of the chopper body. Fiber strands 10 are fed through an opening (not shown) in the back of the chopper body and are threaded between the chopping and backing rollers *6a* and *6b*. The chopping roller *6a* carries a plurality of blades (not shown) that chop the fiber strands 10 into fiber segments, schematically represented by arrows *10a* and *10b*, which are ejected from a nozzle opening 12.

Referring now to FIGS. 1 through 3, the nozzle opening 12 in the body of the chopper 6 normally has a rectangular configuration, although nozzle openings of other configurations are encountered. The fiber deflector 14 of the present invention is positioned between the sides 12*a* and 12*b* of the nozzle and preferably rests on the bottom edge 12*d* of the nozzle. In its preferred form, the fiber deflector 14 is formed from relatively thin sheet metal. The rearward portion 14*d* of the deflector 14 has a downwardly extending lip that conforms to the interior shape of the nozzle body adjacent the bottom of the nozzle opening. The central bottom portion of the deflector 14 that overlies the bottom edge 12*d* of the nozzle opening is substantially planar. The forward portion 14*e* of the deflector extends outwardly form the nozzle and terminates in an arcuate forward edge 14*a*. The side edges 14*b* and 14*c* of the deflector extend outwardly and upwardly from adjacent the rearward portion 14*d* of the deflector and curve to merge with the opposing termini of the forward edge 14*a* of the deflector 14. Thus the forward portion of the deflector 14 forms an outwardly extending and upwardly opening trough 16 that has upwardly divergent sides. The trough 16 functions as a forward extension of the bottom edge portion and side portions of the nozzle opening 12.

The deflector 14 is secured to the body of the chopper by a tab 15 which underlies the deflector and the bottom lip of the nozzle. The tab can be spot welded or otherwise conventionally secured to both the deflector and the chopper body.

In operation, as fiber segments are propelled through the nozzle opening 12, those fiber segments 10*a* that are ejected adjacent the bottom portions of side edges 12*a* and 12*b* of the nozzle opening impinge upon the arcuate upwardly extending sides of the deflector and are deflected inwardly toward the primary flow path of fiber segments indicated by the fiber segment arrows 10*a* and 10*b*. The deflection paths of the fiber segments impinging upon the sides of the deflector 14 follow a path that is shaped somewhat like a segment of a helix, and are schematically illustrated by dashed arrows 18. The deflector 14 thus causes all of the fiber segments issuing from the nozzle 12 to be directed toward a resin spray, which is normally situated immediately below the fiber chopper. The relationship of the chopper and resin spray equipment is described in more detail in U.S. Pat. No. 4,071,389, expressly incorporated above.

In addition, referring to FIG. 4, the deflector 14 unexpectedly causes the resin-impregnated fiber segments to be laid onto a substrate 24 in a relatively flat, wide layer 20 having a substantially uniform thickness. Moreover, the resin-impregnated fiber segments are caused to spread out in a direction transverse to that from which they were directed at the substrate 24 to achieve a wide layer 20 of resin-impregnated fiber segments on the substrate 24. For purposes of comparison, the layer of resin-impregnated fiber segments that is deposited on a substrate 24 by prior art choppers and spray equipment without the deflector of the present invention is illustrated by the dashed line 22 in FIG. 4. As will readily be observed, the prior art layer 22 has an arcuate upper surface, has a relatively thick central portion and is narrower than the layer 20 laid down with the deflector 14 of the present invention.

The deflector of the present invention fulfills the objects and corrects the problems outlined in the background of the invention. Although the present invention has been disclosed in accordance with a preferred embodiment, one of ordinary skill will readily be able to effect various changes, substitutions of equivalents and other alterations without departing from the general concepts disclosed herein. Accordingly, it is intended that the scope of protection granted hereon by Letters Patent be limited only by the definitions contained in the appended claims and equivalents thereof.

The embodiments of the invention in which an exclusive property or privilege is claimed are defined as follows:

1. In a fiber chopper including a body having a nozzle opening, and including means associated with said body for chopping a fiber strand into fiber segments and causing said fiber segments to be ejected from said nozzle along a primary flow path, said nozzle opening having a lower edge portion, an upper edge portion, and sides, an immprovement associated with said nozzle comprising:

means defining a forwardly extending, upwardly opening trough having its longitudinal dimension oriented generally parallel to said primary flow path for receiving fiber segments ejected from said nozzle and causing said fiber segments ejected from the corner portions of said nozzle to be skewed upwardly and inwardly relative to said primary flow path.

2. The improvement of claim 1 wherein said means comprises a deflector member affixed to said body and extending outwardly away from said lower edge portion of said nozzle opening, said deflector member having upwardly extending sides forming said upwardly opeining trough, said sides terminating in an arcuate outer edge spaced outwardly from said lower edge portion of said nozzle opening.

3. The improvement of claim 2 wherein said deflector member has side edges that extend upwardly from a location adjacent the lower edge portion of said nozzle opening and that terminate at intersections with opposite ends of said outer edge.

4. The improvement of claim 2 wherein the lower and upper edge portions and sides of said nozzle opening are arranged in a rectangular configuration, said deflector member having a rearward portion and a forward portion, said rearward portion extending into said body through said nozzle opening, said rearward portion contacting said body adjacent the lower edge portion of said nozzle opening, said forward portion of said member extending outwardly from said nozzle opening and terminating in said outer arcuate edge, the sides of said forward portion being arcuately divergent in an upward direction to form said trough.

5. The improvement of claim 1 further comprising means for affixing said means defining said forwardly extending, upwardly opening trough to said nozzle body.

* * * * *

UNITED STATES PATENT AND TRADEMARK OFFICE

CERTIFICATE OF CORRECTION

PATENT NO. : 4,212,216

DATED : July 15, 1980

INVENTOR(S) : Frank Ives

It is certified that error appears in the above-identified patent and that said Letters Patent are hereby corrected as shown below:

Column 2, line 21, "fibr" should read — fiber —;

Column 2, line 22, "an" should read — and —;

Column 4, line 23, "immprovement" should read — improvement —;

Column 4, line 38, "opeining" should read — opening —;

Column 4, line 42, after "upwardly" insert — and outwardly —;

Column 4, line 45, insert — arcuate — before "outer edge".

Signed and Sealed this

*Seventh* Day of *October 1980*

[SEAL]

*Attest:*

SIDNEY A. DIAMOND

*Attesting Officer*

*Commissioner of Patents and Trademarks*